US007901324B2

(12) United States Patent
Kodama

(10) Patent No.: US 7,901,324 B2
(45) Date of Patent: Mar. 8, 2011

(54) EXERCISE DETECTION APPARATUS

(75) Inventor: Masato Kodama, Itabashi-ku (JP)

(73) Assignee: Tanita Corporation, Itabashi-Ku, Tokyo (JP)

( * ) Notice: Subject to any disclaimer, the term of this patent is extended or adjusted under 35 U.S.C. 154(b) by 44 days.

(21) Appl. No.: 12/534,341

(22) Filed: Aug. 3, 2009

(65) Prior Publication Data

US 2010/0041516 A1 Feb. 18, 2010

(30) Foreign Application Priority Data

Aug. 12, 2008 (JP) ..... 2008-207715

(51) Int. Cl.
*A63B 71/00* (2006.01)

(52) U.S. Cl. ..... 482/8; 482/1; 482/9; 482/92; 482/901

(58) Field of Classification Search ..... 482/1–9, 482/51, 54, 92, 99, 900–902; 73/379.01–379.04; 600/300; 601/23; 434/247
See application file for complete search history.

(56) References Cited

U.S. PATENT DOCUMENTS

| | | | | |
|---|---|---|---|---|
| 5,242,355 | A | 9/1993 | Costa | |
| 5,570,301 | A | 10/1996 | Barrus | |
| 6,719,667 | B2 * | 4/2004 | Wong et al. | 482/54 |
| 7,078,630 | B2 * | 7/2006 | Martin-Woodin et al. | 177/144 |
| 7,353,137 | B2 * | 4/2008 | Vock et al. | 702/173 |

FOREIGN PATENT DOCUMENTS

| | | |
|---|---|---|
| GB | 2 448 880 | 11/2008 |
| JP | 2006-149792 A | 6/2006 |

OTHER PUBLICATIONS

European Search Report issued in Application No. 09166578.6 on Nov. 19, 2009.

* cited by examiner

*Primary Examiner* — Glenn Richman
(74) *Attorney, Agent, or Firm* — Buchanan Ingersoll & Rooney PC

(57) ABSTRACT

An exercise detection apparatus including: a load stage comprising a load surface onto which a load of parts or all of a human subject is applied; a load measurer for repeatedly or continuously measuring the load on the load surface; a calculator for calculating a difference between adjacent local maximum and minimum in the load varying over time measured by the load measurer repeatedly or continuously; and a detector for detecting a motion of the human subject when the difference calculated by the calculator is within a range.

11 Claims, 7 Drawing Sheets

EXERCISE DETECTION APPARATUS

BACKGROUND OF THE INVENTION

1. Field of the Invention

The present invention relates to exercise detection apparatuses.

2. Prior Art/Related Art

JP-A-2006-149792 discloses an exercise detection apparatus including a seat on which a human sits. In this apparatus, each of a plurality of members with which parts of a human body will be in contact includes a load cell to which strain gauges are affixed. When a human subject sitting on the apparatus performs plantar flexion for the ankles, the apparatus detects and counts the motion of plantar flexion if the load exerted by one of the femora onto a bar member above the femur is at maximum and if the load exerted by the ankle corresponding to the femur onto another bar member in front of the ankle is within a permissible range.

This apparatus involves many members with which parts of a human body will be in contact, so that the mechanical structure is complicated. In addition, it is necessary for human subjects to move their body parts to come into contact with the members of the apparatus, and this makes the use difficult.

Accordingly, the present invention provides an exercise detection apparatus with a simple structure that is easy to use.

SUMMARY OF THE INVENTION

In accordance with the present invention, there is provided an exercise detection apparatus including: a load stage including a load surface onto which a load of parts or all of a human subject is applied; a load measurer for repeatedly or continuously measuring the load on the load surface; a calculator for calculating a difference between adjacent local maximum and minimum in the load varying over time measured by the load measurer repeatedly or continuously; and a detector for detecting a motion of the human subject when the difference calculated by the calculator is within a range.

The "motion" to be detected by the present invention includes motions involving change of posture or position of at least part of the body of a human subject, such as a push-up (press-up), a squat, or a forward or backward motion of a push-up or a squat. The "motion" to be detected excludes the motions without change of posture or position, such as the beating of the heart or breathing.

The "range" used for detecting the motion in the present invention is a range having an upper limit and a lower limit within which the difference between adjacent local maximum and minimum in the load on the load surface should fall when a human subject performs the motion appropriately. The upper limit will be determined suitably so as to avoid inappropriate detection of the motion when an abrupt impact is imparted to the load surface accidentally or by excessive exercise. The lower limit will be determined suitably so as to avoid inappropriate detection of motion when the motion extent is excessively small or when the human subject does not perform the motion.

The exercise detection apparatus according to the present invention does not need many members with which parts of a human body will be in contact, so that the structure can be simple. When using the exercise detection apparatus, the human subject simply imparts a load of parts or all of the human subject, so that the apparatus is easy to use.

In an aspect of the present invention, the motion of the human subject is a reciprocating motion including a forward motion and a backward motion, the calculator calculating a first difference between adjacent local maximum and minimum of a first set in the load measured by the load measurer, the detector detecting the forward motion when the first difference calculated by the calculator is within a first range, the calculator calculating a second difference between adjacent local maximum and minimum of a second set in the load measured by the load measurer, the detector detecting the backward motion when the second difference calculated by the calculator is within a second range, the detector detecting the reciprocating motion once the forward motion and the backward motion are detected sequentially. With such a structure, the forward motion can be precisely detected on the basis of the first range dedicated for detection of the forward motion whereas the backward motion can be precisely detected on the basis of the second range dedicated for detection of the backward motion.

In this aspect, the exercise detection apparatus may further include: a first range determiner for determining the first range for the human subject on the basis of a load measured by the load measurer; and a second range determiner for determining the second range for the human subject on the basis of a load measured by the load measurer. With such a structure, both the first and second ranges can be determined for particular human subjects. That is, the first and second ranges can be customized, so that the precision of measurement can be improved.

In this aspect, the exercise detection apparatus may further include: an information guidance device for providing first guidance for prompting the human subject to rest at a first position, and for providing second guidance for prompting the human subject to rest at a second position, a first load applied onto the load surface when the human subject holds still in the first position being less than a second load applied onto the load surface when the human subject holds still in the second position, in which the load measurer measures the first load and the second load on the load surface when the human subject holds still in the first position and in the second position, in which the first range determiner determines the first range for the human subject on the basis of the first load, and in which the second range determiner determines the second range for the human subject on the basis of the second load. With such a structure, the human subject is guided to take positions for which personal data are collected for determining the first and second ranges for this human subject.

The first range determiner may determine the first range for the human subject on the basis of the first load and the second load, and the second range determiner may determine the second range for the human subject on the basis of the first load and the second load. In this case, there is the likelihood that the first and second ranges can be determined more suitably.

In another aspect of the present invention, the exercise detection apparatus may further include: an information guidance device for providing guidance for prompting the human subject to stand up and rest on the load surface, so that the load measurer measures a body weight of the human subject when the human subject stands up and rests on the load surface; and a range determiner for determining the range for the human subject on the basis of the body weight measured by the load measurer. With such a structure, the human subject is guided to take a position in which personal body weight is measured for determining the range for this human subject.

In another aspect of the present invention, the load surface may include a plurality of metrical regions, each of which receives a regional load which is a part of the load as a whole applied on the load surface. The exercise detection apparatus may further include a regional load measurement processor for measuring the respective regional loads. With such a structure, distribution of load of the human subject can be measured.

Each of the metrical regions may include a plurality of measurement sections, each of which receives a sectional load which is a part of the load as a whole applied on the load surface. The exercise detection apparatus may further include a plurality of load sensors provided at the plurality of measurement sections, each of the load sensors converting the sectional load on the corresponding measurement section into an electric signal, in which the load measurer measures the load on the load surface on the basis of electric signals from all of the plurality of load sensors, and in which the regional load measurement processor measures the regional load on each respective metrical region on the basis of electrical signals from load sensors corresponding to the respective metrical region. With such a structure, load sensors can be commonly used for measurement of the load on the load surface and for measurement of the regional loads.

The regional load measurement processor may repeatedly or continuously measure the respective regional loads. The exercise detection apparatus may further include a statistical processor for calculating a statistical value for each of the metrical regions on the basis of the corresponding regional load varying over time measured by the regional load measurement processor repeatedly or continuously. With such a structure, the statistical processor can calculate statistical values for respective metrical regions, which will be useful for estimating distribution of muscular force of the human subject.

The exercise detection apparatus may further include an information device for informing the human subject or an observer of the number of motions detected by the detector.

The exercise detection apparatus may further include an information device for informing the human subject or an observer that the motion has been detected whenever the detector has detected the motion.

BRIEF DESCRIPTION OF THE DRAWINGS

With reference to the accompanying drawings, various embodiments of the present invention will be described hereinafter. In the drawings.

DETAILED DESCRIPTION OF PREFERRED EMBODIMENTS

Figure 1:
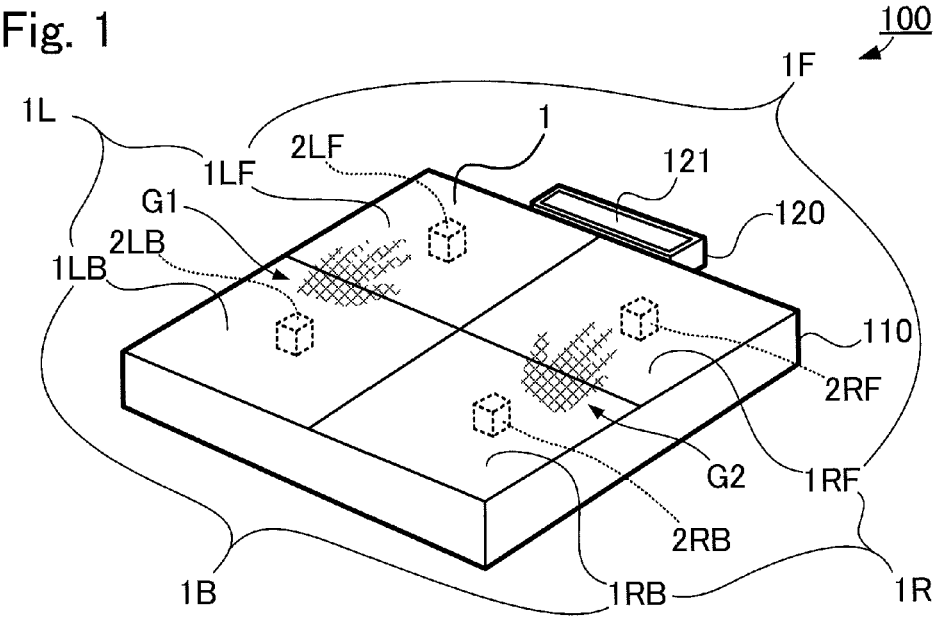
FIG. 1 is a perspective view showing an exercise detection apparatus according to an embodiment of the present invention.

FIG. 1 is a perspective view showing an exercise detection apparatus according to an embodiment of the present invention. The exercise detection apparatus 100 detects and counts push-ups as reciprocating motions of a human body. More specifically, when the apparatus detects a forward motion and then a backward motion corresponding to the forward motion, the apparatus increases the counted number of push-ups by one. The apparatus outputs information for informing the human subject or an observer of the number of detected push-ups.

Figure 2:
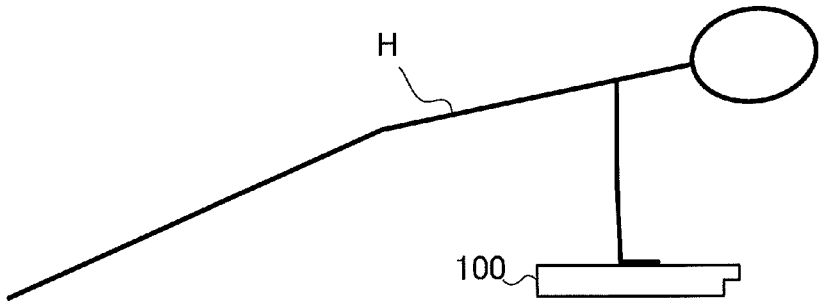
FIG. 2 is a schematic view showing a raised position (first position) in reciprocating motions performed on the exercise detection apparatus.
Figure 3:
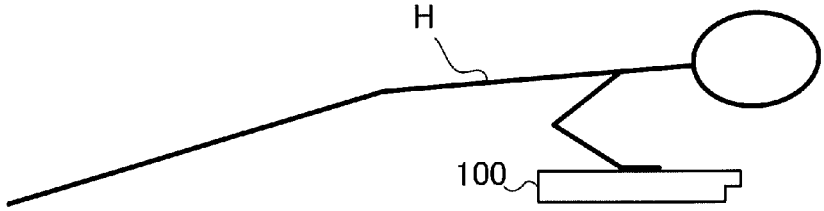
FIG. 3 is a schematic view showing a lowered position (second position) in reciprocating motions performed on the exercise detection apparatus.

In this specification, the forward motion of a push-up means lowering the human body H from a raised position (first position), as shown in FIG. 2, at which the arms are stretched, to a lowered position (second position), as shown in FIG. 3, at which the arms are bent. In contrast, the backward motion of a push-up means raising the human body H from the lowered position at which the arms are bent to the raised position at which the arms are stretched. A push-up is a reciprocating motion constituted of the forward motion and the backward motion.

The exercise detection apparatus 100 includes a main body 110 and a display device 120 attached to the main body 110. The main body 110 is a load stage that includes a load surface 1 onto which a load of parts or all of a human body is applied. A controller inside the main body 110 conducts a total load measurement in which the controller measures the total load exerted onto the load surface 1. When performing push-ups, the human subject puts both hands on the load surface 1.

When the human subject holds still in the raised position as shown in FIG. 2, the total load exerted onto the load surface 1 is less than that when the human subject holds still in the lowered position as shown in FIG. 3. In the specification, the total load on the load surface 1 when the human subject holds still in the raised position as shown in FIG. 2 is referred to as a "lesser static-position load", whereas the total load on the load surface 1 when the human subject holds still in the lowered position as shown in FIG. 3 is referred to as a "greater static-position load".

The load surface 1 includes a plurality of (four in the embodiment) measurement sections 1LF, 1LB, 1RF, and 1RB arranged in two rows and two columns. The measurement sections 1LF, 1LB, 1RF, and 1RB are provided with load sensors 2LF, 2LB, 2RF, and 2RB, respectively, so that each load sensor measures the load exerted onto the measurement section beneath which the load sensor is located. The measurement section 1LF is located in the left column and in the front row. The measurement section 1LB is located in the left column and in the back row. The measurement section 1RF is located in the right column and in the front row. The measurement section 1RB is located in the right column and in the back row. The measurement sections 1LF, 1LB, 1RF, and 1RB may be structurally separated from one another, or may be formed in an integral body such that they are visually distinguishable from one another.

The load surface 1 includes a plurality of (two in the embodiment) metrical regions, i.e., a left metrical region 1L and a right metrical region 1R. When performing push-ups, the human subject puts the left hand on the left metrical region 1L and the right hand on the right metrical region 1R. The left metrical region 1L includes the aforementioned plurality of left measurement sections 1LF and 1LB whereas the right metrical region 1R includes the aforementioned plurality of right measurement sections 1RF and 1RB.

The load surface 1 also includes a plurality of (two in the embodiment) metrical regions, i.e., a front metrical region 1F and a back metrical region 1B. The front metrical region 1F includes the aforementioned plurality of front measurement sections 1LF and 1RF whereas the back metrical region 1B includes the aforementioned plurality of back measurement sections 1LB and 1RB.

Each of the metrical regions 1L and 1R and the metrical regions 1F and 1B is a subject for load measurement and is similar to each of the measurement sections 1LF, 1LB, 1RF, and 1RB, as will be described later. Of course, the metrical regions 1L and 1R may be structurally separated from each other, or may be formed in an integral body such that they are visually distinguishable from each other. The same is true for the metrical regions 1F and 1B.

In the left metrical region 1L, a symbol G1 is depicted for instructing the human subject of the position and orientation of the left hand. The symbol G1 is located over the measurement sections 1LF and 1LB. In the right metrical region 1R, a symbol G2 is depicted for instructing the human subject of the position and orientation of the right hand. The symbol G1 is located over the measurement sections 1RF and 1RB.

On the basis of the respective loads exerted onto the measurement sections 1LF, 1LB, 1RF, and 1RB and measured by the load sensors 2LF, 2LB, 2RF, and 2RB, a controller inside the main body 110 executes the aforementioned total load measurement and two regional load measurements. One of the regional load measurements is a process for measuring the respective loads on the left and right metrical regions 1L and 1R. This process will be referred to as an "intra-column load measurement". The other is a process for measuring the respective loads on the front and back metrical regions 1F and 1B. This process will be referred to as an "intra-row load measurement".

Figure 4:
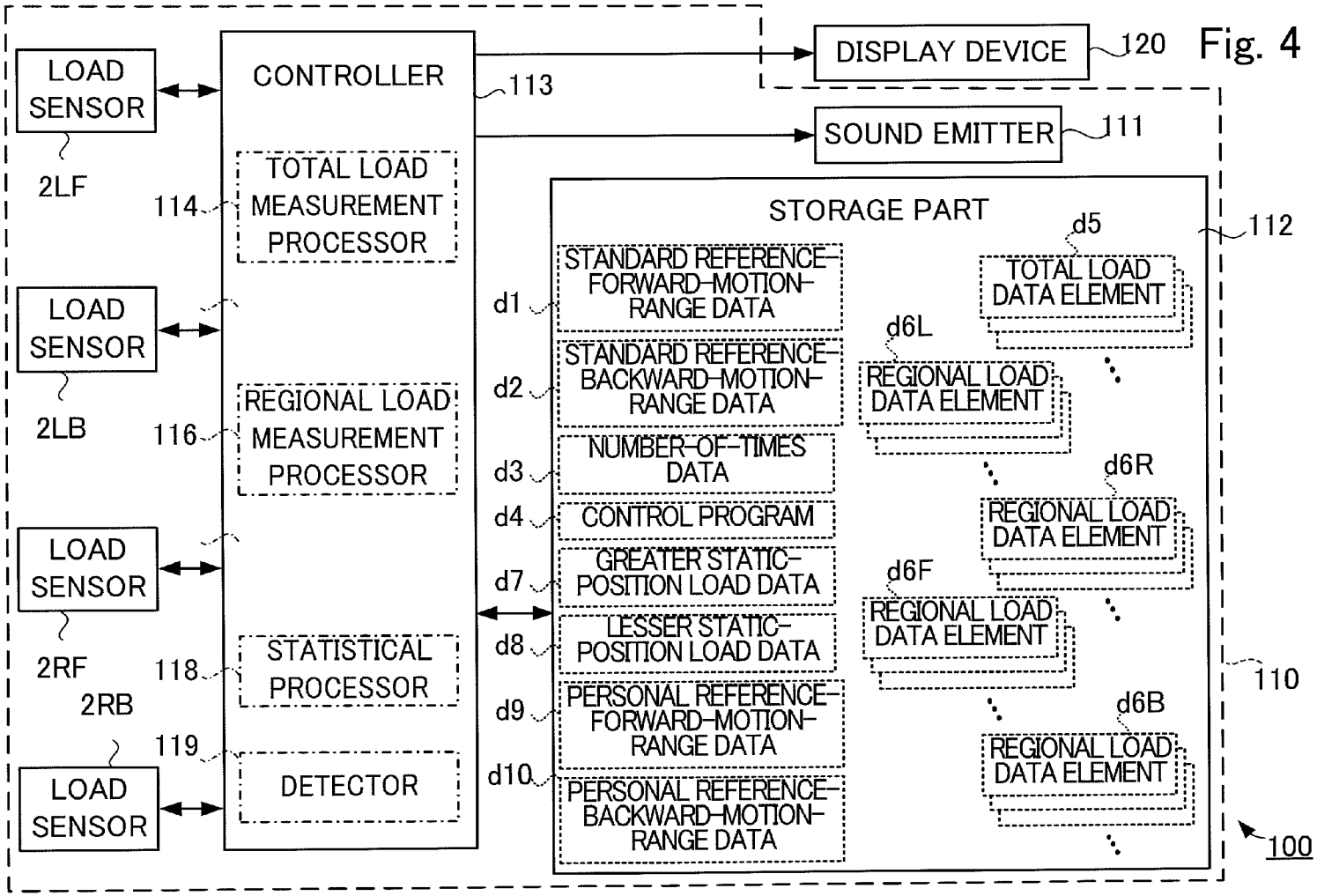
FIG. 4 is a block diagram showing an electrical structure of the exercise detection apparatus of the embodiment.

FIG. 4 is a block diagram showing an electrical structure of the exercise detection apparatus 100. In addition to the aforementioned display device 120 and the load sensors 2LF, 2LB, 2RF, and 2RB, the exercise detection apparatus 100 includes a sound emitter 111, a storage part 112, and a controller 113.

Each load sensor 2LF, 2LB, 2RF, or 2RB is located beneath the corresponding measurement section 1LF, 1LB, 1RF, or 1RB, and converts the sectional load on the corresponding measurement section to an electrical signal. Consequently, the signal output from the load sensor indicates the measured value of the load on the corresponding measurement section. The load sensor may have various structure, e.g., it may include one or more strain gauges.

The display device 120 (information guidance device and information device) includes a screen 121 for displaying images as shown in FIG. 1. The display device 120 may be a liquid crystal display or any other suitable display device. The sound emitter 111 (information guidance device and information device) includes one or more speakers (not shown). The storage part 112 for storing data written therein includes a rewritable storage region and a nonvolatile storage region. The storage part 112 may have various structures, and in this embodiment, the storage part 112 is an EEPROM (electrically erasable programmable read only memory) of which the storage region is a rewritable and nonvolatile storage region. The controller 113 is, for example, a CPU (central processing unit) which can serve as a timer.

The storage part 112 stores standard reference-forward-motion-range data d1 and standard reference-backward-motion-range data d2. The standard reference-forward-motion-range data d1 indicates a standard reference forward motion range which is a suitable range within which the difference between the maximum and the minimum of the total load to be applied onto the load surface 1 should fall when a standard human subject performs the forward motion of a push-up. The standard reference-backward-motion-range data d2 indicates a standard reference backward motion range which is a suitable range within which the difference between the maximum and the minimum of the total load to be applied onto the load surface 1 should fall when a standard human subject performs the backward motion of a push-up. The standard reference forward motion range and the standard reference backward motion range can be statistically determined on the basis of measurement results of many the human subjects.

The storage part 112 also stores number-of-times data d3 indicating the number of detections of push-ups performed by the human subject. The initial value of the number of detections is zero.

Figure 5:
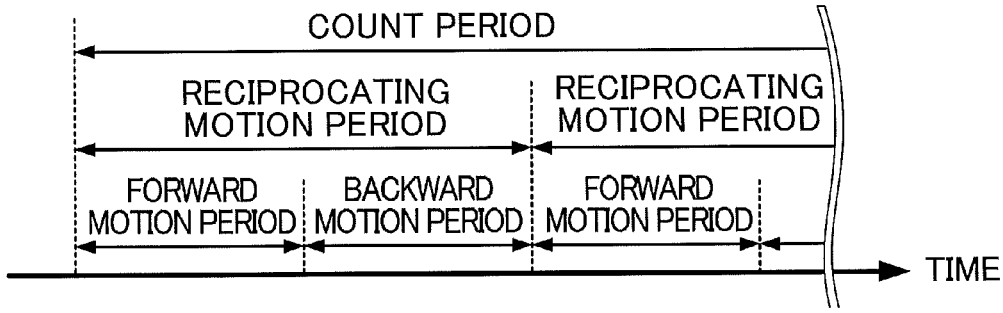
FIG. 5 is a schematic diagram showing a counting process for counting the number of reciprocating motions.

FIG. 5 schematically shows a counting process (reciprocating motion detection) for counting the number of push-ups. The count period starts with the start of push-ups and ends with the end of push-ups. The count period includes one or more reciprocating motion periods. Each reciprocating motion period includes a forward motion period and a backward motion period behind the forward motion period.

Referring back to FIG. 4, the storage part 112 stores a control program d4. The control program d4 is a computer program executed by the controller 113. By executing the control program d4, the controller 113 serves as a total load measurement processor 114, a regional load measurement processor 116, a statistical processor 118 and a detector 119.

The total load measurement processor 114 conducts the aforementioned total load measurement. That is, the total load measurement processor 114 serves as a load measurer for measuring the total load exerted onto the load surface 1 on the basis of the signals supplied from the load sensors 2LF, 2LB, 2RF, and 2RB. More specifically, the total load measurement processor 114 sums up the respective loads indicated by the signals supplied from all of the load sensors to obtain the current total load. Then, the total load measurement processor 114 generates a current total load data element d5 indicating the total load currently obtained, and records it in the storage part 112. The total load measurement processor 114 repeats the total load measurement periodically (intermittently), but the total load measurement processor 114 may conduct the total load measurement continuously.

The regional load measurement processor 116 conducts the aforementioned intra-column load measurement and intra-row load measurement. That is, the regional load measurement processor 116 measures the load (left regional load) exerted onto the left metrical region 1L on the basis of the signals supplied from the corresponding load sensors 2LF and 2LB, generates a current regional load data element d6L indicating the load, and records it in the storage part 112. Similarly, the regional load measurement processor 116 measures the load (right regional load) exerted onto the right metrical region 1R on the basis of the signals supplied from the corresponding load sensors 2RF and 2RB, generates a current regional load data element d6R indicating the load, and records it in the storage part 112. Similarly, the regional load measurement processor 116 measures the load (front regional load) exerted onto the front metrical region 1F on the basis of the signals supplied from the corresponding load sensors 2LF and 2RF, generates a current regional load data element d6F indicating the load, and records it in the storage part 112. Similarly, the regional load measurement processor 116 measures the load (back regional load) exerted onto the back metrical region 1B on the basis of the signals supplied from the corresponding load sensors 2LB and 2RB, generates a current regional load data element d6B indicating the load, and records it in the storage part 112. The regional load measurement processor 116 repeats the set of the four regional load measurements periodically (intermittently), but the regional load measurement processor 116 may conduct this set continuously.

The detector 119 detects push-ups performed by the human subject, as will be described in detail. The statistical processor 118 calculates statistical values for respective left metrical regions.

Figure 6:
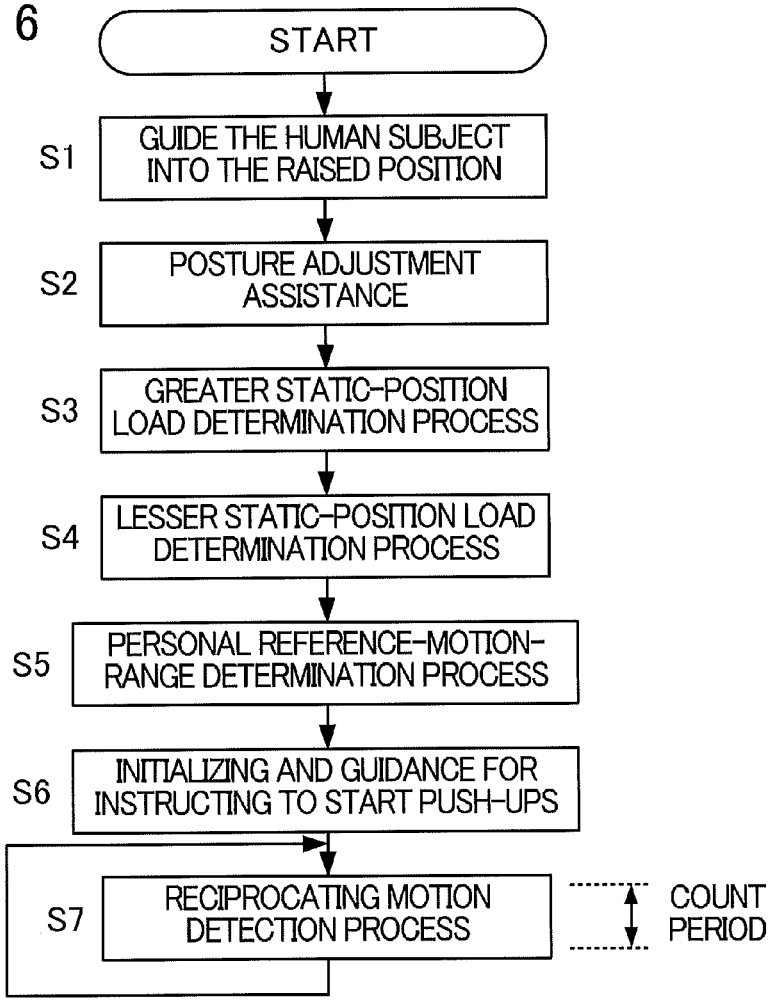
FIG. 6 is a flowchart showing an entire operation executed by the exercise detection apparatus.

FIG. 6 is a flowchart showing an entire operation executed by the controller 113 of the exercise detection apparatus 100. At step S1, the controller 113 guides the human subject into the raised position (first position) shown in FIG. 2. More specifically, the controller 113 causes both or either of the display device 120 and the sound emitter 111 to provide guidance for prompting the human subject to take the raised position. Then, the human subject takes the raised position with the hands placed on the symbols G1 and G2 on the load surface 1. The guidance continues for a certain period (for example, five seconds).

Figure 7:
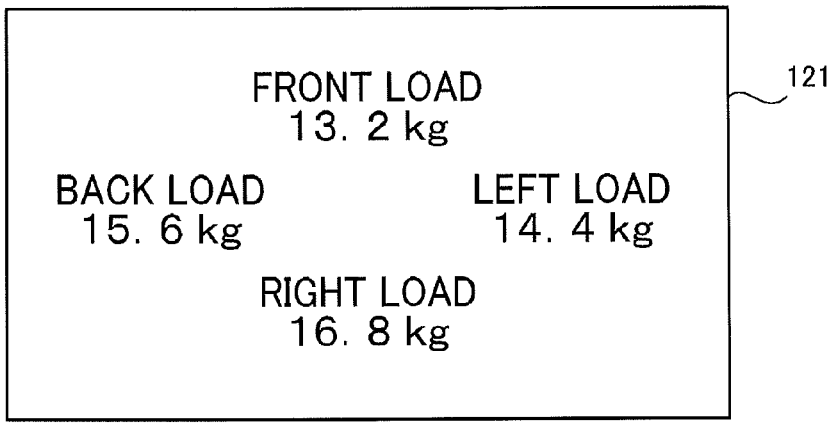
FIG. 7 is a diagram showing an image displayed by a display device of the exercise detection apparatus when the exercise detection apparatus conducts posture adjustment assistance.

At step S2, the controller 113 conducts posture adjustment assistance. More specifically, the controller 113 causes the regional load measurement processor 116 to repeatedly or continuously perform the intra-column load measurement and the intra-row load measurement, and causes the screen 121 of the display device 120 to sequentially show each value of the regional loads measured as shown in FIG. 7. The human subject adjusts the posture viewing the screen 121 until the values are equalized. The posture adjustment assistance continues for a certain period (for example, three seconds).

At step S3, the controller 113 conducts a greater static-position load determination process, which continues for a certain period (for example, four seconds), for determining the greater static-position load. In the greater static-position load determination process, the controller 113 causes both or either of the display device 120 and the sound emitter 111 to provide guidance for prompting the human subject to rest at the lowered position (second position) after a certain period (for example, three seconds), and then the total load measurement processor 114 repeatedly or continuously perform the total load measurement. The controller 113 determines the greater static-position load on the basis of the measured total load varying over time. By the guidance, the human subject moves from the raised position to the lowered position (performs the forward motion) and rests at the lowered position.

Figure 8:
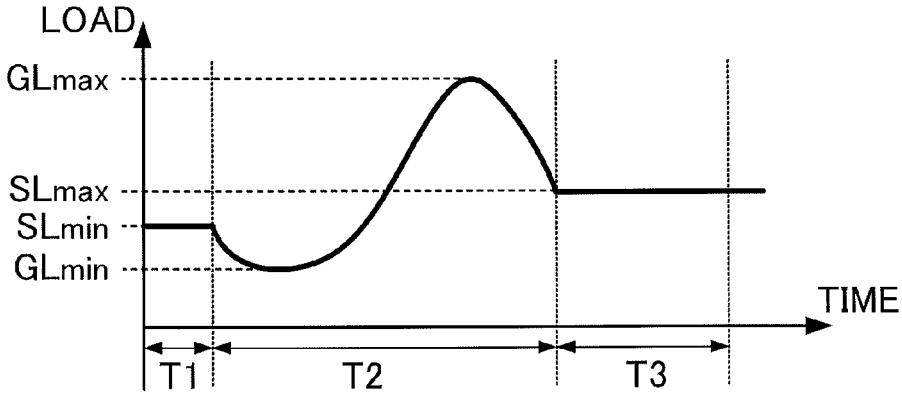
FIG. 8 is a graph showing an example of change of the total load on a load surface of the exercise detection apparatus during the forward motion of the reciprocating motions.

FIG. 8 shows an example of change of the total load on the load surface 1 during the forward motion of a push-up. As shown in FIG. 8, the total load on the load surface 1 is constant at a value $SL_{min}$ for the first period T1 before the human subject starts the forward motion. For the next period T2 when the human subject is moving, the total load first reduces to the minimum $GL_{min}$, then rises to the maximum $GL_{max}$, and finally reduces to a value $SL_{max}$. For the next period T3 after the human subject begins to rest at the lowered position, the total load is constant at the value $SL_{max}$. As in FIG. 8, $GL_{min}<SL_{min}<SL_{max}<GL_{max}$.

In the greater static-position load determination process, the total load measured by the total load measurement processor 114 also varies in a similar manner as shown in FIG. 8. Accordingly, the total load measured by the total load measurement processor 114 at the period T3 is the greater static-position load $SL_{max}$. By the aforementioned guidance, the human subject rests at the lowered position for a certain period (e.g., three seconds) after the guidance, so that the total load on the load surface 1 becomes the value $SL_{max}$ when the certain period has passed after the guidance. The controller 113 determines the total load $SL_{max}$ measured lastly in the greater static-position load determination process as the greater static-position load, and records greater static-position load data d7 indicating the value of the greater static-position load $SL_{max}$ (second load) in the storage part 112.

At step S4, the controller 113 conducts a lesser static-position load determination process, which continues for a certain period (for example, four seconds), for determining the lesser static-position load. In the lesser static-position load determination process, the controller 113 causes both or either of the display device 120 and the sound emitter 111 to provide guidance for prompting the human subject to rest at the raised position (first position) after a certain period (for example, three seconds), and then the total load measurement processor 114 repeatedly or continuously performs the total load measurement. The controller 113 determines the lesser static-position load on the basis of the measured total load varying over time. By the guidance, the human subject moves from the lowered position to the raised position (performs the backward motion) and rests at the raised position.

Figure 9:
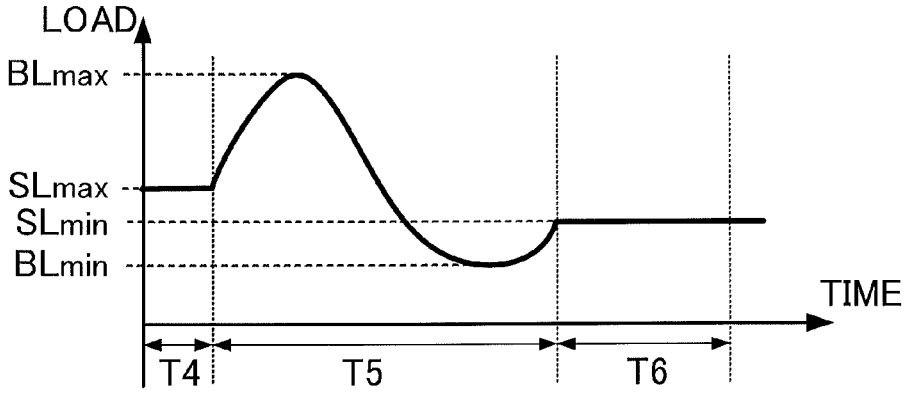
FIG. 9 is a graph showing an example of change of the total load on a load surface of the exercise detection apparatus during the backward motion of the reciprocating motions.

FIG. 9 shows an example of change of the total load on the load surface 1 during the backward motion of a push-up. As shown in FIG. 9, the total load on the load surface 1 is constant at a value $SL_{max}$ for the first period T4 before the human subject starts the backward motion. For the next period T5 when the human subject is moving, the total load first rises to the maximum $BL_{max}$, then reduces to the minimum $BL_{min}$, and finally rises to a value $SL_{min}$. For the next period T6 after the human subject begins to rest at the raised position, the total load is constant at the value $SL_{min}$. As in FIG. 9, $BL_{min}<SL_{min}<SL_{max}<BL_{max}$.

In the lesser static-position load determination process, the total load measured by the total load measurement processor 114 also varies in a similar manner as shown in FIG. 9. Accordingly, the total load measured by the total load measurement processor 114 at the period T6 is the lesser static-position load $SL_{min}$. By the aforementioned guidance, the human subject rests at the raised position for a certain period (e.g., three seconds) after the guidance, so that the total load on the load surface 1 becomes the value $SL_{min}$ when the certain period has passed after the guidance. The controller 113 determines the total load $SL_{min}$ measured lastly in the lesser static-position load determination process as the lesser static-position load, and records lesser static-position load data d8 indicating the value of the lesser static-position load $SL_{min}$ (first load) in the storage part 112.

In an alternative embodiment, after the lesser static-position load determination process, the greater static-position load determination process may be conducted.

As shown in FIG. 8 and FIG. 9, usually $GL_{min}<BL_{min}$ whereas $GL_{max}<BL_{max}$. It is not limited that $BL_{min}-GL_{min}$ is equal to $GL_{max}-BL_{max}$. Accordingly, in the illustrated embodiment, a personal reference forward motion range and a personal reference backward motion range are separately used for detecting the forward motion and the backward motion, as will be described later.

Referring back to FIG. 6, at step S5, the controller 113 conducts a personal reference-motion-range determination process in which the controller 113 serves as a first range determiner for determining a personal reference forward motion range (first range) for the particular human subject and serves as a second range determiner for determining a personal reference backward motion range (second range) for the particular human subject. In the personal reference-motion-range determination process, by an arithmetic process on the basis of the standard reference-forward-motion-range data d1, the standard reference-backward-motion-range data d2, the greater static-position load data d7, and the lesser static-position load data d8, the controller 113 determines the personal reference forward motion range having its upper and lower limits and the personal reference backward motion range having its upper and lower limits. The controller 113 generates personal reference-forward-motion-range data d9 indicating the determined personal reference forward motion range and personal reference-backward-motion-range data d10 indicating the determined personal reference backward motion range, and records the personal reference-forward-motion-range data d9 and the personal reference-backward-motion-range data d10 in the storage part 112.

The arithmetic process for determining the personal reference forward motion range and the personal reference backward motion range is not limited. For example, the personal reference forward motion range (first range) may be determined on the basis of the standard reference-forward-motion-range data d1 and the lesser static-position load data d8, whereas the personal reference backward motion range (second range) may be determined on the basis of the standard reference-backward-motion-range data d2 and the greater static-position load data d7. In an another example, the personal reference forward motion range (first range) may be determined on the basis of the standard reference-forward-motion-range data d1, the greater static-position load data d7, and the lesser static-position load data d8, whereas the personal reference backward motion range (second range) may be determined on the basis of the standard reference-backward-motion-range data d2, the greater static-position load data d7, and the lesser static-position load data d8.

The personal reference forward motion range indicated by the personal reference-forward-motion-range data d9 is a suitable range within which the difference between adjacent local maximum and minimum of the total load on the load surface 1 falls when the human subject performs the forward motion of push-ups. That is, the personal reference forward motion range is a suitable range of the forward motion for this particular human subject, and is different from the standard reference forward motion range indicated by the standard reference-forward-motion-range data d1 since the standard reference forward motion range is a suitable range of the forward motion for an imaginary standard human subject.

As will be understood from FIG. 8, the maximum value $GL_{max}$ and the minimum value $GL_{min}$ for the forward motion have relation to the value $SL_{min}$ (indicated by the lesser static-position load data d8), so that the personal reference forward motion range (first range) can be determined on the basis of the value $SL_{min}$. In addition, as will be understood from FIG. 8, the maximum value $GL_{max}$ and the minimum value $GL_{min}$ for the forward motion have relation to the value $SL_{max}$ (indicated by the greater static-position load data d7) and the value $SL_{min}$ (indicated by the lesser static-position load data d8), so that the personal reference forward motion range (first range) can be more precisely determined on the basis of the values $SL_{max}$ and $SL_{min}$.

The personal reference backward motion range indicated by the personal reference-backward-motion-range data d10 is a suitable range within which the difference between adjacent local maximum and minimum of the total load on the load surface 1 falls when the human subject performs the backward motion of push-ups. That is, the personal reference backward motion range is a suitable range of the backward motion for this particular human subject, and is different from the standard reference backward motion range indicated by the standard reference-backward-motion-range data d2 since the standard reference backward motion range is a suitable range of the backward motion for an imaginary standard human subject.

As will be understood from FIG. 9, the maximum value $BL_{max}$ and the minimum value $BL_{min}$ for the backward motion have relation to the value $SL_{max}$ (indicated by the greater static-position load data d7), so that the personal reference backward motion range (second range) can be determined on the basis of the value $SL_{max}$. In addition, as will be understood from FIG. 9, the maximum value $BL_{max}$ and the minimum value $BL_{min}$ for the backward motion have relation to the value $SL_{max}$ (indicated by the greater static-position load data d7) and the value $SL_{min}$ (indicated by the lesser static-position load data d8), so that the personal reference backward motion range (second range) can be more precisely determined on the basis of the values $SL_{max}$ and $SL_{min}$.

At step S6, the controller 113 initializes the number-of-times data d3 (i.e., renew the number-of-times data d3 to zero) and deletes all of the total load data elements d5 and regional load data elements d6L, d6R, d6F, and d6B stored in the storage part 112. In addition, the controller 113 causes both or either of the display device 120 and the sound emitter 111 to provide guidance for instructing to start push-ups.

Thereafter, the controller 113 repeats a reciprocating motion detection process, i.e., a counting process (step S7). As shown in FIG. 5, the count period starts with the start of the first reciprocating motion period. The count period ends with the end of the final reciprocating motion period.

Figure 10:
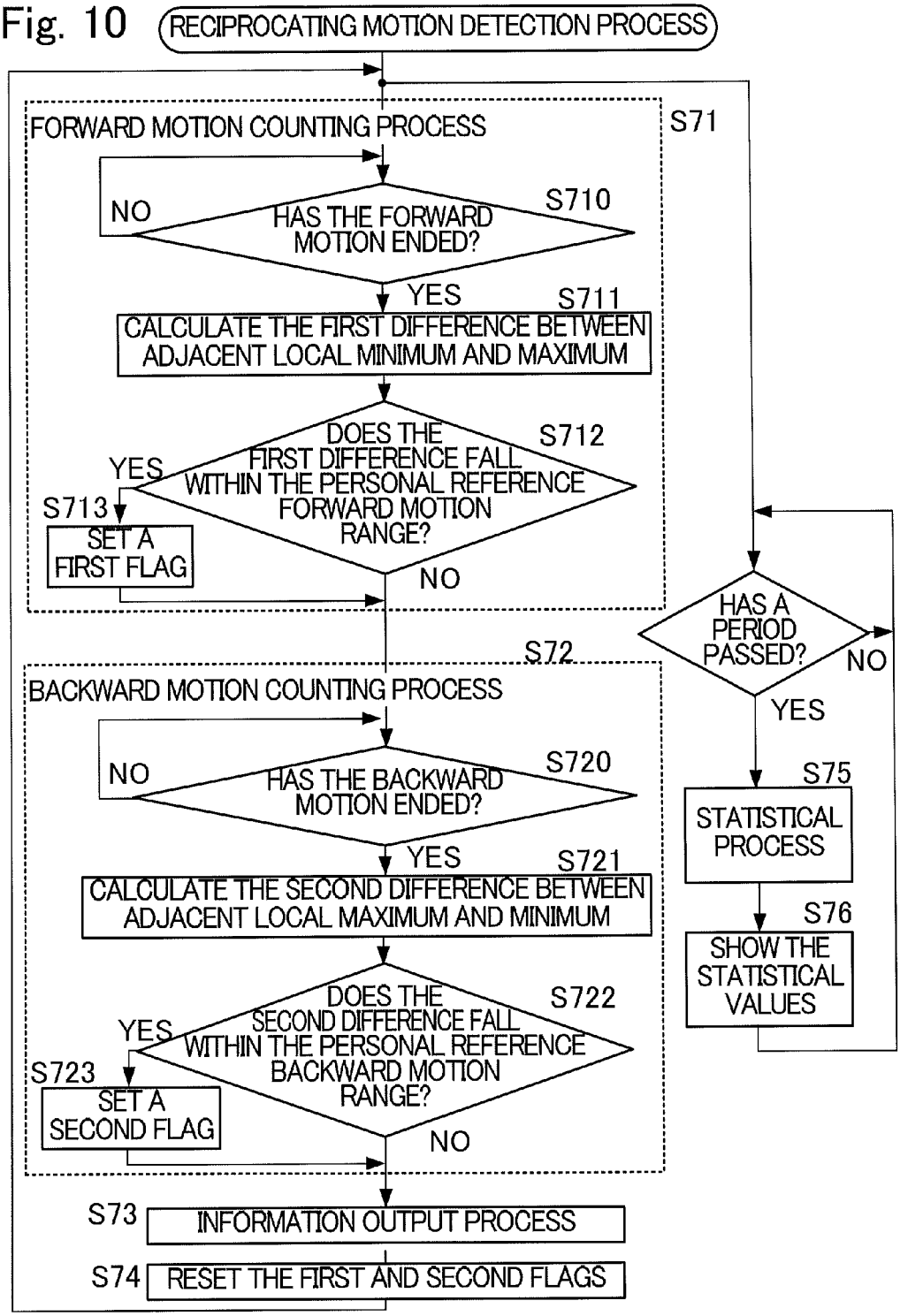
FIG. 10 is a flowchart showing a reciprocating motion detection process executed by the exercise detection apparatus.

FIG. 10 is a flowchart showing the reciprocating motion detection process (step S7). In the reciprocating motion detection process, the controller 113 conducts a forward motion counting process at step S71 for determining whether or not a suitable forward motion is detected. On the basis of change in the total load varying over time measured by the total load measurement processor 114, the controller 113 can determine the start and the end of the actual forward motion since the load reduces, rises and then reduces during the forward motion as shown in FIG. 8.

In the forward motion counting process, the controller 113 determines at step S710 whether or not the forward motion has ended. If the forward motion has ended, the controller 113 serves as a calculator at step S711 for calculating the first difference between adjacent local minimum and maximum of a first set in the total load varying over time measured by the total load measurement processor 114. More specifically, the controller 113 chooses the local minimum and the local maximum among the total load values indicated by the total load data elements d5 sequentially generated by the total load measurement processor 114 during the last forward motion, and calculates the first difference therebetween. Then, the controller 113 serves as a comparer for comparing the first difference with the personal reference forward motion range indicated by the personal reference-forward-motion-range data d9 and serves as the aforementioned detector 119 for determining whether or not the first difference falls within the personal reference forward motion range at step S712. Thus, the detector 119 detects a suitable forward motion when the first difference is within the personal reference forward motion range (first range).

If the determination at step S712 is negative, the process proceeds to step S72. If the determination at step S712 is affirmative, the process proceeds to step S713 in which the controller 113 sets a first flag, which means a suitable forward motion has been detected, and then the process proceeds to step S72.

Thus, the controller 113 finishes the forward motion counting process and conducts a backward motion counting process at step S72 for determining whether or not a suitable backward motion is detected. On the basis of change in the total load varying over time measured by the total load measurement processor 114, the controller 113 can determine the start and the end of the actual backward motion since the load rises, falls, and then rises during the backward motion as shown in FIG. 9.

In the backward motion counting process, the controller 113 determines at step S720 whether or not the backward motion has ended. If the backward motion has ended, the controller 113 serves as a calculator at step S721 for calculating the second difference between adjacent local maximum and minimum of a second set in the total load varying over time measured by the total load measurement processor 114. More specifically, the controller 113 chooses the local maximum and the local minimum among the total load values indicated by the total load data elements d5 sequentially generated by the total load measurement processor 114 during the last backward motion, and calculates the second difference therebetween. Then, the controller 113 serves as a comparer for comparing the second difference with the personal reference backward motion range indicated by the personal reference-backward-motion-range data d10 and serves as the aforementioned detector 119 for determining whether or not the second difference falls within the personal reference backward motion range at step S722. Thus, the detector 119 detects a suitable backward motion when the second difference is within the personal reference backward motion range (second range).

If the determination at step S722 is negative, the process proceeds to step S73. If the determination at step S722 is affirmative, the process proceeds to step S723 in which the controller 113 sets a second flag, which means a suitable backward motion has been detected, and then the process proceeds to step S73.

Thus, the controller 113 finishes the backward motion counting process and conducts an information output process at step S73. In the information output process, the controller 113 serves as the detector 119 for counting up push-ups. If the first and second flags are set, the detector 119 renews the number-of-times data d3 so as to increase the number of detections of push-ups by one, and the controller 113 causes both or either of the display device 120 and the sound emitter 111 to inform the human subject or an observer of the number of detected push-ups. Thus, the detector 119 counts up the number of detected push-ups if the determinations at steps S712 and S722 are affirmative. Otherwise, the detector 119 does not count up the number of detected push-ups. In other words, the detector 119 detects the reciprocating motion once the forward motion and the backward motion are detected sequentially at steps S712 and S722.

After step S73, the controller 113 resets the first and second flags (not shown) at step S74, and the process returns to step S71 for repeating the reciprocating motion detection process.

The reciprocating motion detection process may end when a predetermined time period has passed from the start of the reciprocating motion detection process. In an alternative embodiment, the reciprocating motion detection process may end when the human subject or the observer manipulates an interface (not shown) for having the process end. In another alternative embodiment, the reciprocating motion detection process may end when the human subject takes the hands off from the load surface 1 and the total load measurement processor 114 measures nothing.

During the reciprocating motion detection process, the controller 113 serves as the aforementioned statistical processor 118 (see FIG. 4) for conducting a statistical process (step S75) in which the statistical processor 118 calculates a statistical value for each of the left and right metrical regions 1L and 1R on the basis of the regional load varying over time measured by the regional load measurement processor 116 repeatedly or continuously. The statistical processor 118 repeats the statistical process at regular time intervals.

For example, in the statistical process, the statistical processor 118 calculates a left muscular force which is, in this embodiment, the average of the left regional load values applied on the left metrical region 1L on the basis of the left regional load data elements d6L stored in the storage part 112. The statistical processor 118 also calculates a right muscular force which is, in this embodiment, the average of the right regional load values applied on the right metrical region 1R on the basis of the right regional load data elements d6R stored in the storage part 112.

Figure 11:
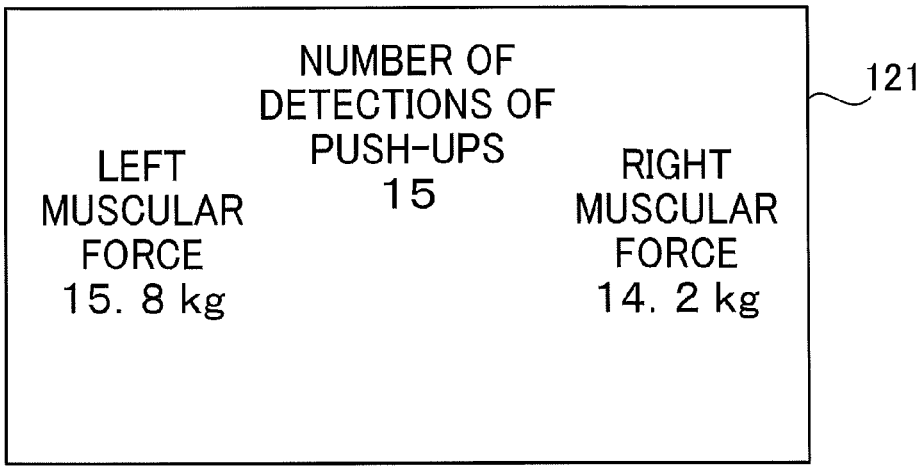
FIG. 11 is a diagram showing an image displayed in the display device of the exercise detection apparatus when the exercise detection apparatus conducts the reciprocating motion detection process.

At step S76, the controller 113 causes the display device 120 to show the statistical values for respective metrical regions. FIG. 11 shows an image displayed by the display device 120, in which the statistical values for respective metrical regions are displayed. Accordingly, the human subject or the observer is informed of the right and left distribution of muscular force of the human subject.

Additionally or alternatively, the statistical processor 118 may calculate a statistical value for each of the front and back metrical regions 1F and 1B on the basis of the regional load varying over time measured by the regional load measurement processor 116 repeatedly or continuously. In this case, the human subject or the observer is informed of the front and back distribution of muscular force of the human subject.

In this embodiment, the calculated statistical value is the average of regional load values. However, it is not intended to limit the present invention to this. The calculated statistical value may be another statistical value which is suitable for evaluating partial muscular force of the human subject, e.g., the average of local maximums of regional load values, the average of local minimums of regional load values, or the sum of regional load values.

As has been described above, in accordance with the exercise detection apparatus 100, as long as the human subject performs push-ups within suitable load ranges, the number of detections of push-ups is incremented by one. The human subject or the observer is informed of the number of detections of push-ups and of the statistical values of respective regional loads on respective metrical regions.

MODIFICATIONS

While the present invention has been particularly shown and described with references to preferred embodiments thereof, it will be understood by those skilled in the art that various changes in form and details may be made therein without departing from the scope of the invention as claimed by the claims. Such variations, alterations, and modifications are intended to be encompassed in the scope of the present invention. Examples of such variations, alterations, and modifications will be described below.

Figure 12:
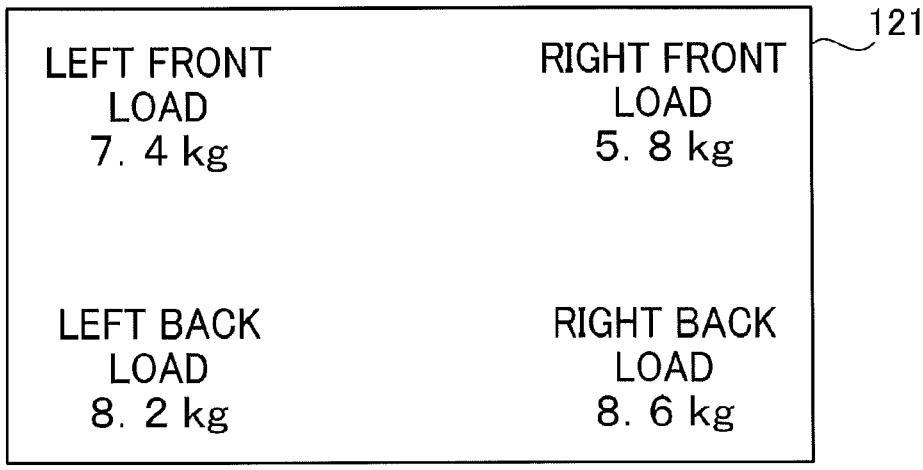
FIG. 12 is a diagram showing an image displayed in the display device of the exercise detection apparatus when the exercise detection apparatus conducts posture adjustment assistance in accordance with a modification of the embodiment.

In a modification, at the posture adjustment assistance (step S2), the controller 113 may cause the display device 120 to show each value of the sectional loads on the measurement sections 1LF, 1LB, 1RF, and 1RB as shown in FIG. 12, rather than the regional loads.

In the above-described embodiment, the load surface 1 includes four measurement sections 1LF, 1LB, 1RF, and 1RB. However, the number of measurement sections may be less than four or greater than four.

In an modification, it is not necessary that the load surface 1 include the left and right metrical regions 1L and 1R.

In another modification, it is not necessary that the load surface 1 include the front and back metrical regions 1F and 1B.

The load surface 1 may include three or more metrical regions aligned in one direction.

Each metrical region may include a single measurement section or three or more measurement sections.

Different metrical regions may include different numbers of measurement sections.

In the above-described embodiment, each of steps S1 through S4 in FIG. 6 continues for a certain period. However, the period of each or either of these steps may be variable. For example, in the posture adjustment assistance (step S2), the controller 113 may calculate the difference between the left and right regional loads obtained by the intra-column load measurement and may compare the difference with a predetermined range. The controller 113 may also calculate the difference between the front and back regional loads obtained by the intra-low load measurement and may compare the difference with a predetermined range. If both of the differences are within the ranges, the posture adjustment assistance (step S2) may end.

In a modification, at the greater static-position load determination process (S3), the controller 113 may measure a time period in which the repeatedly or continuously measured total load is within a reference range. If the time period reaches a threshold, the controller 113 may calculate a statistical value (e.g., the average) of the repeatedly or continuously measured total load values, and determines the statistical value to be the greater static-position load.

In the above-described embodiment, the human subject or the observer is informed of the right and left distribution of muscular force of the human subject, the front and back distribution of muscular force of the human subject, or both. However, such report of the distribution of muscular force may be omitted.

In a modification, both or either of the display device 120 and the sound emitter 111 may be omitted. Instead, an outside information guidance device, such as a television set, may perform the role of information guidance. In another modification, a set of light emitting devices, such as light emitting diodes, may be used as an information guidance device.

In the above-described embodiment, all of the load sensors 2 are commonly used for the regional load measurement and the total load measurement. In a modification, it is possible to provide a plurality of load sensors for the regional load measurement and to provide one or more load sensors for the total load measurement. In another modification, it is possible to provide one or more load sensors only for the total load measurement.

In the above-described embodiment, the forward and backward motions are detected on the basis of the personal reference forward motion range and the personal reference backward motion range for the particular human subject, which are determined on the basis of a test applied to the human subject. In a modification, the forward and backward motions may be detected on the basis of the standard reference forward motion range and the standard reference backward motion range.

In the above-described embodiment, the lesser and greater static-position loads are used for determining the personal reference forward motion range and the personal reference backward motion range. Additionally or alternatively, the total body weight of the human subject may be used by the controller 113 (range determiner) for determining the personal reference forward motion range and the personal reference backward motion range. In this case, both or either of the display device 120 and the sound emitter 111 may provide guidance for prompting the human subject to stand up and rest on the load surface 1 for measuring the body weight, and then the total load measurement processor 114 measures the body weight of the human subject. In addition, the exercise detection apparatus 100 may estimate the energy consumption of the human subject per push-up on the basis of the body weight of the human subject, and/or may estimate the energy consumption of the human subject during a plurality of push-ups on the basis of the body weight of the human subject and the number of detected push-ups.

In the above-described embodiment, the exercise detection apparatus 100 detects push-ups in which both hands of a human subject are put on the load surface 1. In a modification, an exercise detection apparatus may detect another motion of a human subject in which the load of all of a human subject is applied onto a load surface. For example, such an exercise detection apparatus may detect push-ups in which both feet of a human subject are placed onto a load surface.

Figure 13:
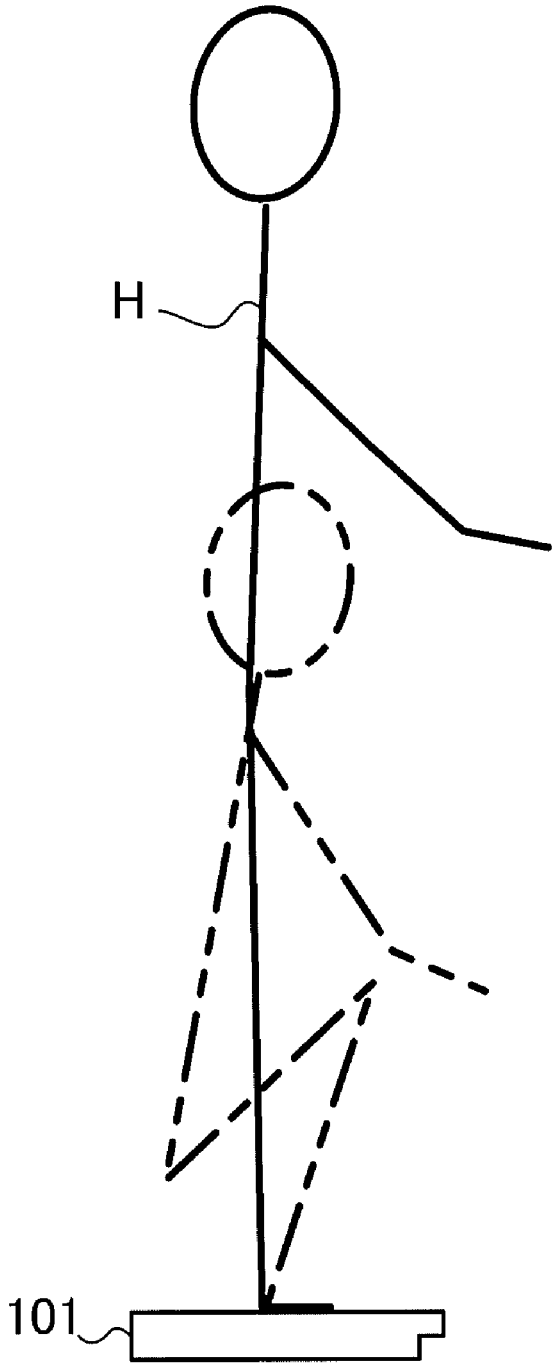
FIG. 13 is a schematic view showing reciprocating motions performed on an exercise detection apparatus in accordance with a modification of the embodiment.

In another example, such an exercise detection apparatus 101 may detect squats when both feet of a human body H are placed onto a load surface whereby the load of all of a human subject is applied onto the load surface as shown in FIG. 13. For squats, when the human subject holds still in the standing position (first position) with the legs stretched, the total load exerted onto the load surface is less than that when the human subject holds still in the crouching position (second position) with the legs are bent. For squats, the aforementioned personal reference forward motion range may be usually the same as the personal reference backward motion range, and therefore either of the greater static-position load determination process (S3) or the lesser static-position load determination process (S4) may be omitted. For squats, at the posture adjustment assistance (S2), the intra-row load measurement can be omitted since it is usually meaningless to check the front and back distribution of load of the human subject (differently from push-ups).

In the above-described embodiment, the length of the period required for both the forward motion and the backward motion is not limited in advance. In a modification, in advance of the exercise, it is possible to fix the limit of length of both or either of the forward motion and the backward motion. For example, the human subject may freely set the length. In this modification, when the detector does not detect a suitable forward motion within a forward motion limit period or when the detector does not detect a suitable backward motion within a backward motion limit period, the detector does not detect or count the reciprocating motion corresponding to the forward or backward motion. In this modification, preferably, both or either of the display device 120 and the sound emitter 111 may inform the human subject of the start and/or end of each of a forward motion limit period, a backward motion limit period, or a reciprocating motion limit period.

In a modification, it is possible to settle an upper limit for the number of detected reciprocating motions and to instruct the human subject of the end of exercise when the number of detected reciprocating motions reaches the upper limit. This upper limit (target number) may be freely set by the human subject. In another modification, it is possible to settle the length of the count period. This length of the count period (target length) may also be freely set by the human subject.

In the above-described embodiment, the human subject or an observer is informed of the number of detected reciprocating motions. Additionally or alternatively, both or either of the display device 120 and the sound emitter 111 may inform the human subject or an observer of the number of one or both of suitably detected forward motions and backward motions. Additionally or alternatively, whenever at least one of a forward motion, a backward motion, or a reciprocating motion is detected suitably, both or either of the display device 120 and the sound emitter 111 may inform the human subject or an observer that a suitable motion has been detected, by emitting, for example, a sound, such as beep.

In the above-described embodiment, the exercise detection apparatus detects reciprocating motions (push-ups or squats). However, it is possible for the exercise detection apparatus to detect only forward motions or backward motions.

In a modification, various data indicating one or more of the first and second differences, the date of exercise, the number of detected motions, and the distribution of muscular force may be recorded in the storage part 112 or any other suitable information storage medium. The human subject can be informed of the recorded information with the information device, such as the display device 120, when the human subject so desires. Thus, the human subject can be aware either or both of the history and the degree of development of the muscles of the human subject.

In the above-described embodiment, the total load data elements d5 are used for determining adjacent local maximum and minimum in the total load on the load surface 1, and then if the difference therebetween falls within a suitable range, the number of detected motions is counted up. The total load data elements d5 indicating change in the total load may be used for another purpose, for example, for calculating the motion speed which is the number of detected motions per unit of time. Based on the motion speed and the exercise load, a value indicating degree of exercise burden, e.g., the momentum, may be calculated. The exercise load may be the difference between the global or local maximum and the global or local minimum in the total load on the load surface 1.

The momentum is more appropriate for estimating the effect of exercise, although the number of detected motions also indicates the effect of exercise. This is because the heavier the body weight, the greater the momentum even if the numbers of the detected motions are equal. In addition, the exercise load that is the difference between the maximum and the minimum in the total load is smaller for a lighter human subject than that for a heavier human subject. Furthermore, although the exercise loads are equal, the momentum is greater for quick motions. If the controller 113 of the exercise detection apparatus calculates the momentum, the human subject can be aware of the effect of exercise more precisely. The controller 113 may cause the display device 120 to show the momentum.

What is claimed is:

1. An exercise detection apparatus comprising:

a load stage comprising a load surface onto which a load of parts or all of a human subject is applied;

a load measurer for repeatedly or continuously measuring the load on the load surface;

a calculator for calculating a difference between adjacent local maximum and minimum in the load varying over time measured by the load measurer repeatedly or continuously; and a detector for detecting a motion of the human subject when the difference calculated by the calculator is within a range.

2. The exercise detection apparatus according to claim 1, wherein the motion of the human subject is a reciprocating motion comprising a forward motion and a backward motion, the calculator calculating a first difference between adjacent local maximum and minimum of a first set in the load measured by the load measurer, the detector detecting the forward motion when the first difference calculated by the calculator is within a first range, the calculator calculating a second difference between adjacent local maximum and minimum of a second set in the load measured by the load measurer, the detector detecting the backward motion when the second difference calculated by the calculator is within a second range, the detector detecting the reciprocating motion once the forward motion and the backward motion are detected sequentially.

3. The exercise detection apparatus according to claim 2, further comprising:

a first range determiner for determining the first range for the human subject on the basis of a load measured by the load measurer; and a second range determiner for determining the second range for the human subject on the basis of a load measured by the load measurer.

4. The exercise detection apparatus according to claim 3, further comprising:

an information guidance device for providing first guidance for prompting the human subject to rest at a first position, and for providing second guidance for prompting the human subject to rest at a second position, a first load applied onto the load surface when the human subject holds still in the first position being less than a second load applied onto the load surface when the human subject holds still in the second position, wherein the load measurer measures the first load and the second load on the load surface when the human subject holds still in the first position and in the second position, wherein the first range determiner determines the first range for the human subject on the basis of the first load, and wherein the second range determiner determines the second range for the human subject on the basis of the second load.

5. The exercise detection apparatus according to claim 4, wherein the first range determiner determines the first range for the human subject on the basis of the first load and the second load, and wherein the second range determiner determines the second range for the human subject on the basis of the first load and the second load.

6. The exercise detection apparatus according to claim 1, further comprising:

an information guidance device for providing guidance for prompting the human subject to stand up and rest on the load surface, the load measurer measuring a body weight of the human subject when the human subject stands up and rests on the load surface; and a range determiner for determining the range for the human subject on the basis of the body weight measured by the load measurer.

7. The exercise detection apparatus according to claim 1, wherein the load surface comprises a plurality of metrical regions, each of which receives a regional load which is a part of the load as a whole applied on the load surface, the exercise detection apparatus further comprising a regional load measurement processor for measuring the respective regional loads.

8. The exercise detection apparatus according to claim 7, wherein each of the metrical regions comprises a plurality of measurement sections measurement section, each of which receives a sectional load which is a part of the load as a whole applied on the load surface, the exercise detection apparatus further comprising a plurality of load sensors provided to the plurality of measurement sections, each of the load sensors converting the sectional load on the corresponding measurement section to an electrical signal, wherein the load measurer measures the load on the load surface on the basis of electrical signals from all of the plurality of load sensors, and wherein the regional load measurement processor measures the regional load on each respective metrical region on the basis of electrical signals from load sensors corresponding to the respective metrical region.

9. The exercise detection apparatus according to claim 7 or 8, wherein the regional load measurement processor repeatedly or continuously measures the respective regional loads, the exercise detection apparatus further comprising a statistical processor for calculating a statistical value for each of the metrical regions on the basis of the corresponding regional load varying over time measured by the regional load measurement processor repeatedly or continuously.

10. The exercise detection apparatus according to claim 1, further comprising an information device for informing the human subject or an observer of a number of motions detected by the detector.

11. The exercise detection apparatus according to claim 1, further comprising an information device for informing the human subject or an observer that the motion has been detected whenever the detector has detected the motion.

* * * * *